US006428137B1

(12) United States Patent
Iwaishi et al.

(10) Patent No.: US 6,428,137 B1
(45) **Date of Patent: *Aug. 6, 2002**

(54) INKJET PRINTING METHOD AND DEVICE

(75) Inventors: Akira Iwaishi, Tokyo; Akihiko Miyaki, Yokohama; Takumi Kawamura, Fuchu; Masahiro Ono, Zama, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 12 days.

(21) Appl. No.: 09/246,705

(22) Filed: Feb. 9, 1999

(30) Foreign Application Priority Data

Jul. 31, 1998 (JP) ..... 10-217579

(51) Int. Cl.[7] ..... B41J 2/205
(52) U.S. Cl. ..... 347/15
(58) Field of Search ..... 347/15, 10, 11, 347/9

(56) References Cited

U.S. PATENT DOCUMENTS 5,631,675 A 5/1997 Futagawa
5,906,481 A 5/1999 Ogawa et al.
6,154,228 A * 11/2000 Okuda et al. ..... 347/10

FOREIGN PATENT DOCUMENTS

| | | |
|---|---|---|
| EP | 827838 | * 11/1998 |
| JP | 6-155732 | 6/1994 |
| JP | 7-148920 | 6/1995 |
| JP | 8-85210 | 4/1996 |
| JP | 9-39244 | 2/1997 |

* cited by examiner

*Primary Examiner*—John Barlow
*Assistant Examiner*—Ly Tran
(74) *Attorney, Agent, or Firm*—Armstrong, Westerman & Hattori, LLP

(57) ABSTRACT

A halftone printing is realized by jetting ink drops of mutually different sizes toward a print medium. Among them, the ink drop having the middle size is set to be a reference ink drop for determining injection timings of the ink drops. When the ink drop to be jetted is bigger than the reference ink drop, an injection timing thereof is delayed relative to that of the reference ink drop. On the other hand, when the ink drop to be jetted is smaller than the reference ink drop, an injection timing thereof is advanced relative to that of the reference ink drop. This allows all the ink drops to be hit upon the print medium precisely at given positions.

23 Claims, 4 Drawing Sheets

INKJET PRINTING METHOD AND DEVICE

BACKGROUND OF THE INVENTION

1. Field of the Invention

The present invention relates to an on-demand inkjet printing method and an on-demand inkjet printing device for printing characters and/or images for use in a printer, a plotter, a facsimile device, a copying machine or the like.

2. Description of the Prior Art

Printing devices such as printers are essential in the recent office automation environment, and even personal-use printing devices have been widely spreading. Among them, with respect to the printers, attention has been more paid to inkjet printers as compared with wire printers which perform printing by magnetically driving wires to press them onto a platen via an ink ribbon and a print medium such as a sheet of paper. As appreciated, as compared with the wire printer, the inkjet printer produces less noise and carries out high-speed printing with less printing cost per sheet.

In the inkjet printing, ink drops of different volumes or sizes are injected for forming dots of different sizes on a print medium so as to realize a halftone printing. In this case, the ink drops are jetted successively at constant periods (T[sec]).

Normally, the multi-pass printing is carried out wherein ink drops of the same size are successively jetted on one line, then ink drops of another same size are successively jetted on the same line, which are repeated to jet the ink drops of various sizes without changing the line.

In the foregoing halftone printing, however, there is a serious problem that a disorder of an output image is caused due to the fact that dots are not formed at predetermined positions on the print medium.

Although such a disorder of the output image is prevented in the multi-pass printing, there is a drawback that the printing speed is lowered.

The present inventors tried to seek the reason why the dots are not formed at the predetermined positions on the print medium, and found out that the ink drops hit upon the print medium at positions other than the predetermined positions due to differences in size of the ink drops. Specifically, when the ink drops of different sizes are injected, the flying speed increases as the volume or mass of the ink drop increases. As speed differences among the ink drops increase, the accuracy of the hit positions of the ink drops on the print medium is lowered to degrade the quality of the output image.

SUMMARY OF THE INVENTION

Therefore, it is an object of the present invention to provide an improved inkjet printing method that can eliminate one or more of the disadvantages inherent in the foregoing conventional techniques.

It is another object of the present invention to provide an improved inkjet printing device that can eliminate one or more of the disadvantages inherent in the foregoing conventional techniques.

According to a first aspect of the present invention, there is provided an inkjet printing method wherein ink drops injected from a nozzle one by one to be hit upon a print medium have at least two different sizes, the method comprising the step of changing an injection timing of the ink drop from the nozzle depending on the size of the ink drop to be injected.

It may be arranged that the ink drop having one of the at least two different sizes is set to be a reference ink drop for determining the injection timing and, when the ink drop to be injected is bigger than the reference ink drop, the injection timing thereof is delayed relative to a given drive period of the reference ink drop.

It may be arranged that the ink drop having one of the at least two different sizes is set to be a reference ink drop for determining the injection timing and, when the ink drop to be injected is smaller than the reference ink drop, the injection timing thereof is advanced relative to a given drive period of the reference ink drop.

As the size (volume) of the ink drop increases, the flying speed increases so that the ink drop reaches the print medium earlier. Therefore, if the injection timing is delayed correspondingly, the ink drop hits upon the print medium precisely at a target position. In contrast, as the size of the ink drop decreases, the flying speed decreases so that the ink drop reaches the print medium later. Therefore, if the injection timing is advanced correspondingly, the ink drop hits upon the print medium precisely at a target position. In this fashion, the accuracy of a hit position of the ink drop on the print medium can be enhanced to improve the quality of an output image.

According to a second aspect of the present invention, there is provided an inkjet printing method wherein at least two kinds of drive waveforms having different amplitudes are supplied depending on print data and an ink drop is injected from a nozzle by displacing a meniscus of ink in the nozzle according to each of the drive waveforms, the method comprising the step of changing an injection timing of the ink drop from the nozzle depending on the amplitude of the corresponding drive waveform.

In the foregoing first aspect of the present invention, the injection timing of the ink drop is determined depending on the size of the ink drop to be injected. Normally, the ink drop is injected by displacing the meniscus of ink in the nozzle so as to first retreat the meniscus from a tip of the nozzle and then suddenly force it forward. In this event, the size of the ink drop to be injected can be adjusted by changing the amplitude of the applied drive waveform to control the backward and forward displacement of the meniscus. Accordingly, the second aspect of the present invention defines the structure in terms of the displacement of the meniscus.

It may be arranged that the ink drop to be injected by the drive waveform having one of the different amplitudes is set to be a reference ink drop for determining the injection timing and, when the amplitude of the drive waveform for the ink drop to be injected is greater than the amplitude of the drive waveform for the reference ink drop, the injection timing thereof is delayed relative to a given drive period of the reference ink drop.

It may be arranged that the ink drop to be injected by the drive waveform having one of the different amplitudes is set to be a reference ink drop for determining the injection timing and, when the amplitude of the drive waveform for the ink drop to be injected is smaller than the amplitude of the drive waveform for the reference ink drop, the injection timing thereof is advanced relative to a given drive period of the reference ink drop.

As the amplitude of the applied drive waveform increases, the size of the ink drop increases so that the flying speed increases and thus the ink drop reaches the print medium earlier. Therefore, it is necessary to delay the injection timing correspondingly. In contrast, as the amplitude of the applied drive waveform decreases, the size of the ink drop decreases so that the flying speed decreases and thus the ink drop reaches the print medium later. Therefore, it is necessary to advance the injection timing correspondingly.

According to a third aspect of the present invention, there is provided an inkjet printing method wherein when ink drops are injected from a nozzle one by one, at least two kinds of pressure variations having different amplitudes are applied to ink in the nozzle, the method comprising the step of changing an injection timing of the ink drop from the nozzle depending on the amplitude of the pressure variation applied to the ink.

When injecting the ink drop by feeding the drive waveform to displace the meniscus of ink, the amplitude of the pressure variation applied to the ink upon injection differs depending on the amplitude of the drive waveform. Accordingly, the third aspect of the present invention defines the structure in terms of the pressure variation applied to the ink.

It may be arranged that the ink drop to be injected by the pressure variation having one of the different amplitudes is set to be a reference ink drop for determining the injection timing and, when the amplitude of the pressure variation for the ink drop to be injected is greater than the amplitude of the pressure variation for the reference ink drop, the injection timing thereof is delayed relative to a given drive period of the reference ink drop.

It may be arranged that the ink drop to be injected by the pressure variation having one of the different amplitudes is set to be a reference ink drop for determining the injection timing and, when the amplitude of the pressure variation for the ink drop to be injected is smaller than the amplitude of the pressure variation for the reference ink drop, the injection timing thereof is advanced relative to a given drive period of the reference ink drop.

As the amplitude of the pressure variation applied to the ink increases, the size of the ink drop increases so that the flying speed increases and thus the ink drop reaches the print medium earlier. Therefore, it is necessary to delay the injection timing correspondingly. In contrast, as the amplitude of the pressure variation applied to the ink decreases, the size of the ink drop decreases so that the flying speed decreases and thus the ink drop reaches the print medium later. Therefore, it is necessary to advance the injection timing correspondingly.

According to a fourth aspect of the present invention, there is provided an inkjet printing method wherein when ink drops are injected from a nozzle one by one, the ink drops have at least two different initial injection speeds, the method comprising the step of changing an injection timing of the ink drop from the nozzle depending on the initial injection speed of the ink drop to be injected.

Depending on the size of the ink drop to be injected, the initial injection speed of the ink drop also differs. Accordingly, the fourth aspect of the present invention defines the structure in terms of the initial injection speed of the ink drop.

It may be arranged that the ink drop to be injected at one of the two different initial injection speeds is set to be a reference ink drop for determining the injection timing and, when the initial injection speed of the ink drop to be injected is greater than the initial injection speed of the reference ink drop, the injection timing thereof is delayed relative to a given drive period of the reference ink drop.

For example, the injection timing is delayed by time_1 [sec] relative to the given drive period of the reference ink drop, $$\text{time_}\mathbf{1}=L\times|(1/v\mathbf{1})-(1/v_def)|$$

wherein L represents a distance [mm] from a tip of the nozzle to a print medium, v1 represents the initial injection speed [m/s] of the ink drop to be injected, and v_def represents the initial injection speed [m/s] of the reference ink drop.

It may be arranged that the ink drop to be injected at one of the two different initial injection speeds is set to be a reference ink drop for determining the injection timing and, when the initial injection speed of the ink drop to be injected is smaller than the initial injection speed of the reference ink drop, the injection timing thereof is advanced relative to a given drive period of the reference ink drop.

For example, the injection timing is advanced by time_3 [sec] relative to the given drive period of the reference ink drop, $$\text{time_}\mathbf{3}=L\times|(1/v\mathbf{3})-(1/v_def)|$$

wherein L represents a distance [mm] from a tip of the nozzle to a print medium, v3 represents the initial injection speed [m/s] of the ink drop to be injected, and v_def represents the initial injection speed [m/s] of the reference ink drop.

According to a fifth aspect of the present invention, there is provided an inkjet printing device comprising a drive waveform feed device for feeding at least two kinds of drive waveforms having different amplitudes depending on print data; a deform device which deforms according to the drive waveform fed from the drive waveform feed device; a pressure chamber which is supplied with ink and injects an ink drop via a nozzle by displacing a meniscus of the ink filled therein due to pressures applied to the ink and caused by deformation of the deform device; and a timing adjusting device which receives the amplitudes of the drive waveforms from the drive waveform feed device and adjusts a feed timing of the corresponding drive waveform to the deform device depending on the corresponding amplitude thereof, so that an injection timing of the ink drop via the nozzle is changed depending on the amplitude of the corresponding drive waveform.

The fifth aspect of the present invention deals with the device structure which can control an injection amount of the ink drop by controlling the amplitude of the drive waveform to control the meniscus displacement.

It may be arranged that the ink drop to be injected by the drive waveform having one of the different amplitudes is set to be a reference ink drop for determining the injection timing and, when the amplitude of the drive waveform for the ink drop to be injected is greater than the amplitude of the drive waveform for the reference ink drop, the timing adjusting device delays the feed timing of the drive waveform for the ink drop to be injected so that the injection timing thereof is delayed relative to a given drive period of the reference ink drop.

It may be arranged that the ink drop to be injected by the drive waveform having one of the different amplitudes is set to be a reference ink drop for determining the injection timing and, when the amplitude of the drive waveform for the ink drop to be injected is smaller than the amplitude of the drive waveform for the reference ink drop, the timing adjusting device advances the feed timing of the drive waveform for the ink drop to be injected so that the injection timing thereof is advanced relative to a given drive period of the reference ink drop.

The foregoing drive waveform feed device may be in the form of a specific circuit comprising digital-analog converters etc. or may be realized by a software control so as to feed the drive waveforms. Similarly, the foregoing timing adjusting device may be in the form of a specific circuit or may be realized by a software control. Further, the foregoing deform device may be in the form of a piezoelectric element, but is not limited thereto. Specifically, as long as it is subjected to deformation, such as expansion/contraction, shear deformation or bending deformation due to a bimorph effect, in response to applied voltage or the like, there is no particular limitation.

According to a sixth aspect of the present invention, there is provided an inkjet printing device comprising a drive waveform feed device for feeding drive waveforms; a deform device which deforms according to the drive waveform fed from the drive waveform feed device; and a pressure chamber which is supplied with ink and injects an ink drop via a nozzle due to pressure variation applied to the ink filled therein and caused by deformation of the deform device, the pressure variation having at least two kinds of amplitudes depending on the deformation of the deform device, wherein an injection timing of the ink drop via the nozzle is changed depending on the amplitude of the pressure variation applied to the ink.

The sixth aspect of the present invention deals with the device structure which can control an injection amount of the ink drop by controlling the amplitude of the pressure variation applied to the ink.

It may be arranged that the ink drop to be injected by the pressure variation having one of the amplitudes is set to be a reference ink drop for determining the injection timing and, when the amplitude of the pressure variation for the ink drop to be injected is greater than the amplitude of the pressure variation for the reference ink drop, the injection timing thereof is delayed relative to a given drive period of the reference ink drop.

It may be arranged that the ink drop to be injected by the pressure variation having one of the amplitudes is set to be a reference ink drop for determining the injection timing and, when the amplitude of the pressure variation for the ink drop to be injected is smaller than the amplitude of the pressure variation for the reference ink drop, the injection timing thereof is advanced relative to a given drive period of the reference ink drop.

According to a seventh aspect of the present invention, there is provided an inkjet printing device comprising a drive waveform feed device for feeding drive waveforms; a deform device which deforms according to the drive waveform fed from the drive waveform feed device; and a pressure chamber which is supplied with ink and injects an ink drop via a nozzle due to change in internal volume of the pressure chamber caused by deformation of the deform device, the volume change having at least two kinds of amplitudes depending on the deformation of the deform device, wherein an injection timing of the ink drop via the nozzle is changed depending on the amplitude of the volume change.

The seventh aspect of the present invention deals with the device structure which can control an injection amount of the ink drop by changing the volume of the pressure chamber filled with the ink to control the amplitude of the pressure variation applied to the ink.

It may be arranged that the ink drop to be injected by the volume change having one of the amplitudes is set to be a reference ink drop for determining the injection timing and, when the amplitude of the volume change for the ink drop to be injected is greater than the amplitude of the volume change for the reference ink drop, the injection timing thereof is delayed relative to a given drive period of the reference ink drop.

It may be arranged that the ink drop to be injected by the volume change having one of the amplitudes is set to be a reference ink drop for determining the injection timing and, when the amplitude of the volume change for the ink drop to be injected is smaller than the amplitude of the volume change for the reference ink drop, the injection timing thereof is advanced relative to a given drive period of the reference ink drop.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, a preferred embodiment of the present invention will be described hereinbelow with reference to the accompanying drawings.

Figure 1:
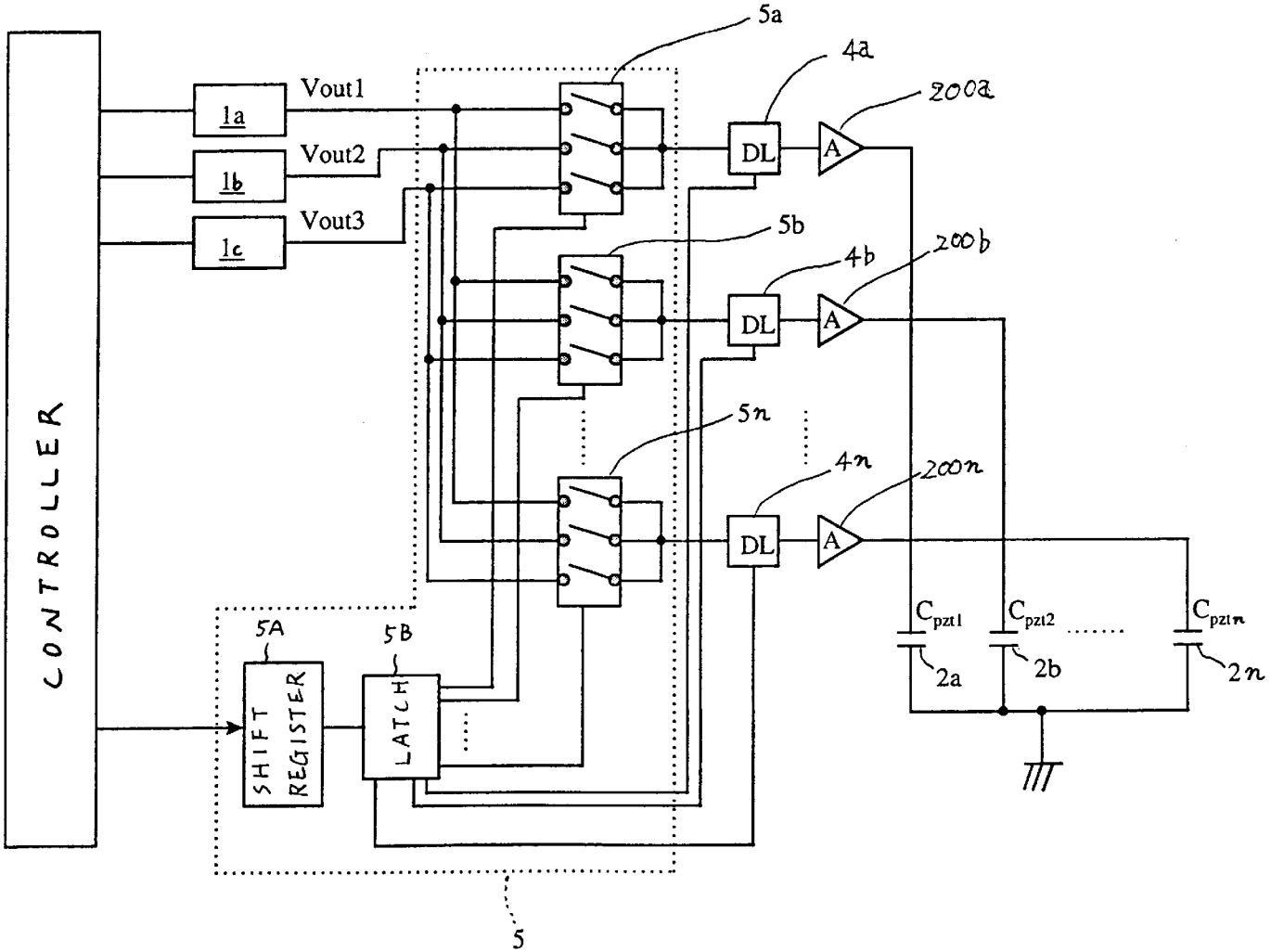
FIG. 1 is a diagram showing a circuit structure of a multi-tone inkjet printer according to a preferred embodiment of the present invention.

FIG. 1 shows a circuit structure of a multi-tone inkjet printer according to the preferred embodiment of the present invention. As shown in the figure, the inkjet printer comprises a drive waveform feed device including circuits 1*a*, 1*b*, 1*c* for outputting drive waveforms Vout1, Vout2, Vout3, respectively, and a deform device including piezoelectric elements 2*a*, 2*b*, . . . , 2*n* which deform (expand/contract) depending on the drive waveforms Vout1, Vout2, Vout3 applied thereto. The inkjet printer further comprises a switching device 5 including switches 5*a*, 5*b*, . . . , 5*n*, a shift register 5A and a latch 5B for choosing, according to print data fed from a controller, the piezoelectric elements to be fed with the drive waveforms. Specifically, according to a driving pattern of the piezoelectric elements 2*a*, 2*b*, . . . , 2*n* determined by the controller according to the print data, the switching device 5 chooses the necessary piezoelectric elements from among the piezoelectric elements 2*a*, 2*b*, . . . , 2*n* so that each of the chosen piezoelectric elements receives corresponding one of the drive waveforms Vout1, Vout2 and Vout3.

The inkjet printer further comprises a timing adjusting device including delay circuits 4*a*, 4*b*, . . . , 4*n* for adjusting feed timings of the drive waveforms to the piezoelectric elements 2*a*, 2*b*, . . . , 2*n* depending on the amplitudes of the applied drive waveforms. The drive waveforms outputted from the delay circuits 4*a*, 4*b*, . . . , 4*n* are fed to amplifiers 200*a*, 200*b*, . . . , 200*n* where losses caused by the delay circuits are compensated, and then fed to the piezoelectric elements 2*a*, 2*b*, . . . , 2*n*.

In this embodiment, the amplitudes of the drive waveforms are inputted from the drive waveform feed circuits 1*a*, 1*b*, 1*c* into the delay circuits 4*a*, 4*b*, . . . , 4*n*, so that the feed timings of the drive waveforms to the piezoelectric elements 2*a*, 2*b*, . . . , 2*n* are adjusted according to the amplitudes of the drive waveforms. Specifically, when injecting an ink drop greater in size than a reference ink drop (in this case, an amplitude of a drive waveform for the subject ink drop is greater than that for the reference ink drop), a delay for the subject ink drop determined by the corresponding delay circuit becomes greater than a reference delay for the reference ink drop, so that the feed timing of the drive waveform for the subject ink drop to the corresponding piezoelectric element is retarded or delayed relative to an injection or drive period of the reference ink drop, that is, as compared with the feed timing of the drive waveform for the reference ink drop. On the other hand, when injecting an ink drop smaller in size than the reference ink drop (in this case, an amplitude of a drive waveform for the subject ink drop is smaller than that for the reference ink drop), a delay for the subject ink drop determined by the corresponding delay circuit becomes smaller than the reference delay for the reference ink drop, so that the feed timing of the drive waveform for the subject ink drop to the corresponding piezoelectric element is advanced relative to the drive period of the reference ink drop, that is, as compared with the feed timing of the drive waveform for the reference ink drop.

Now, behavior of the meniscus of the ink upon injection of the ink drop using the printer shown in FIG. 1 will be explained with reference to FIGS. 2 and 3.

Figure 2:
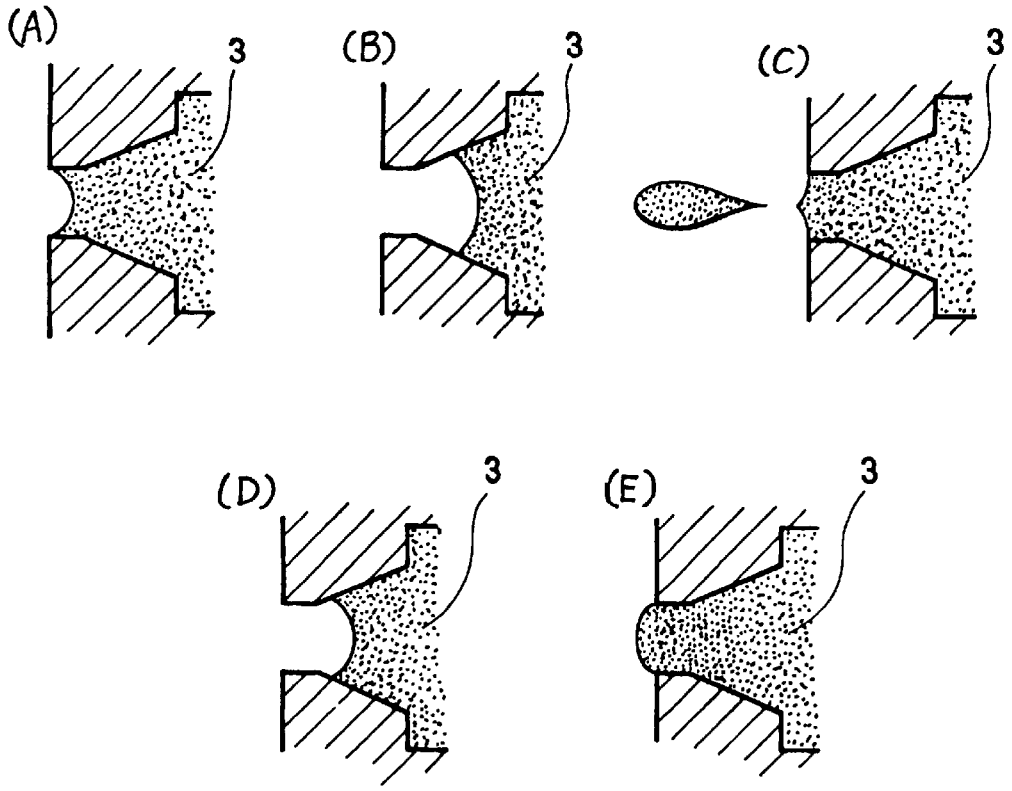
FIG. 2 is a diagram in the form of sectional views of a nozzle for explaining behavior of a meniscus of ink when an ink drop is injected using the printer shown in FIG. 1.
Figure 3:
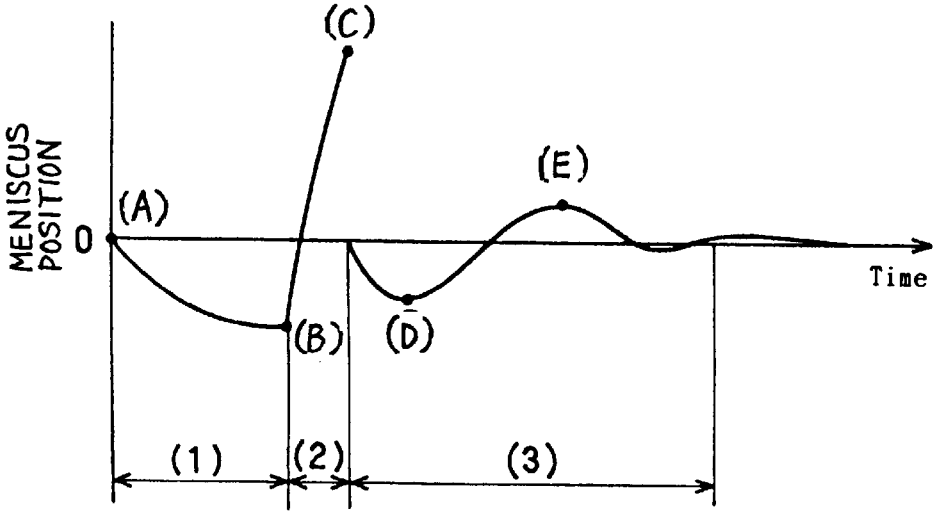
FIG. 3 is a time chart showing a positional variation of the meniscus in the printer shown in FIG. 1.

(A) in FIGS. 2 and 3

The meniscus is at a default position.

(B) in FIGS. 2 and 3

Voltage of the drive waveform applied to the piezoelectric element is lowered to reduce the pressure in the pressure chamber 3, so that the meniscus retreats.

(C) in FIGS. 2 and 3

Voltage of the drive waveform applied to the piezoelectric element is sharply raised to cause a sudden increase of the pressure in the pressure chamber 3, so that an ink drop is injected. A changing point H (see FIG. 4) where the voltage changes from decreasing to increasing represents an injection timing.

(D) and (E) in FIGS. 2 and 3

The meniscus vibrates due to residual energy.

Assuming that a resolution is represented by x [dpi] and a throughput speed of a printhead is represented by speed [mm/sec], a relation thereof with a drive frequency f [kHz] and a drive period KT (=1/f)[sec] is given by $$\{25.4[\mathrm{mm}]/x[\mathrm{dpi}]\}/\mathrm{speed}[\mathrm{mm/sec}]=KT(=1/f)[\mathrm{sec}] \quad (1)$$

Accordingly, a time between injection timings represents a time interval between dots on a print medium when reference ink drops are successively injected per drive period KT [sec]. When the number of kinds of ink drops to be jetted is an odd number, the reference ink drop is defined as one of them having the middle size. On the other hand, when the number is an even number, the reference ink drop is defined as one of them which is set to have the same speed difference relative to the minimum and maximum ink drops.

It is assumed that three kinds of ink drops, that is, big, middle and small ink drops, are injected and that the middle ink drop is set to be a reference ink drop. In this case, assuming that initial injection speeds of the big, middle and small ink drops are v1, v_def and v3 [m/s](v1>v_def>v3), respectively, the big ink drop hits upon the print medium time_1 [sec] earlier than the middle ink drop, while the small ink drop hits upon the print medium time_3 [sec] later than the middle ink drop. Thus, hit positions of the big and small ink drops on the print medium are deviated or dislocated correspondingly relative to a hit position of the middle, i.e. reference, ink drop.

The foregoing time_1 [sec] is given by $$\mathrm{time_1}=L\times|(1/v1)-(1/v_def)| \quad (2)$$

wherein time_1 represents a hit time difference [sec], L represents a distance [mm] from a tip of the nozzle to the print medium, and v1 and v_def represent the initial injection speeds [m/s] of the big and middle ink drops, respectively.

The foregoing time_3 [sec] is given by $$\mathrm{time_3}=L\times|(1/v3)-(1/v_def)| \quad (3)$$

wherein time_3 represents a hit time difference [sec], L represents the distance [mm] from the tip of the nozzle to the print medium, and v3 and v_def represent the initial injection speeds [m/s] of the small and middle ink drops, respectively.

Accordingly, when jetting the big ink drop having a flying speed higher than that of the middle ink drop, the injection timing thereof is delayed by time_1 [sec] relative to the drive period KT [sec]. On the other hand, when jetting the small ink drop having a flying speed lower than that of the middle ink drop, the injection timing thereof is advanced by time_3 [sec] relative to the drive period KT [sec]. This cancels an influence caused by a difference in speed of the ink drops having different sizes so as to prevent dislocation of the corresponding dots on the print medium.

Figure 4:
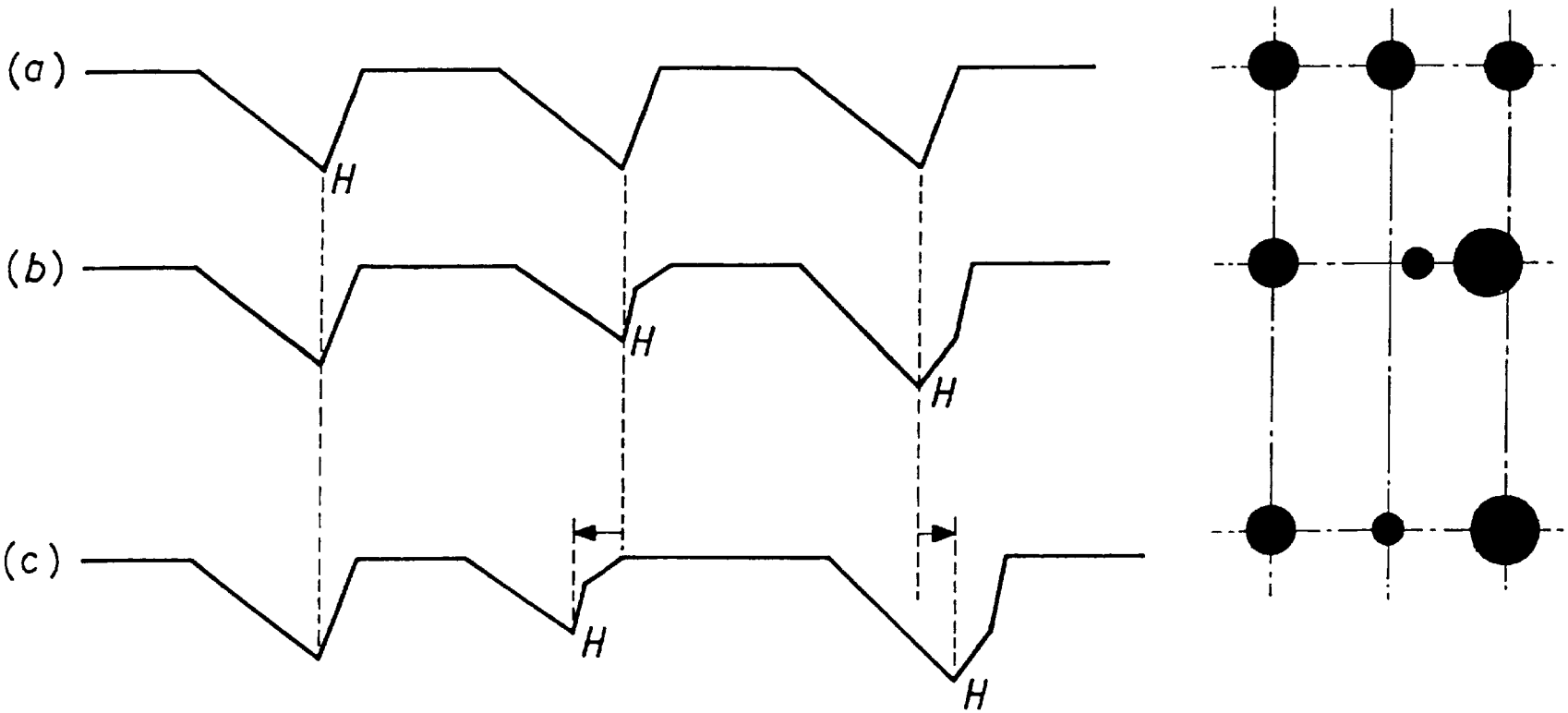
FIG. 4 is a diagram for explaining a relationship between a time chart of drive waveforms fed to a piezoelectric element for injecting ink drops, and corresponding hit positions of the ink drops on a print medium.

FIG. 4 shows a relationship between a time chart of the drive waveforms fed to the piezoelectric element and the corresponding hit positions of the ink drops on the print medium when the big, middle and small ink drops are jetted. In FIG. 4, (a) shows the waveforms when the middle ink drops are injected per drive period KT, and the resultant dots on the print medium, (b) shows the waveforms when the big, small and middle ink drops are injected per drive period KT, and the resultant dots on the print medium, which corresponds to the prior art, and (c) shows the waveforms when the big, small and middle ink drops are injected according to the preferred embodiment of the present invention, and the resultant dots on the print medium. As seen from the figure, when only the middle ink drops are jetted, since all the ink drops have the same size, the ink drops precisely hit upon the print medium at given positions. On the other hand, when the three kinds of ink drops, that is, the big, middle and small ink drops, are jetted at the constant drive periods KT as in the prior art, the small ink drop having a lower flying speed hits upon the print medium after the given position, while the big ink drop hits upon the print medium before the given position. In contrast, according to the preferred embodiment of the present invention, the injection timing of the big ink drop is delayed relative to the drive period KT while the injection timing of the small ink drop is advanced relative to the drive period KT, so that all the ink drops hit upon the print medium precisely at the given positions.

As described above, according to the preferred embodiment of the present invention, the accuracy of the hit positions of the ink drops on the print medium during the halftone printing is improved so that degradation in quality of the output image, which would be otherwise caused by the dislocation of the dots on the print medium due to differences in size of the ink drops, can be prevented.

Further, since the halftone printing is realized by the single-pass printing in the preferred embodiment of the present invention, the printing speed can be highly increased as compared with the multi-pass printing.

Figure 5:
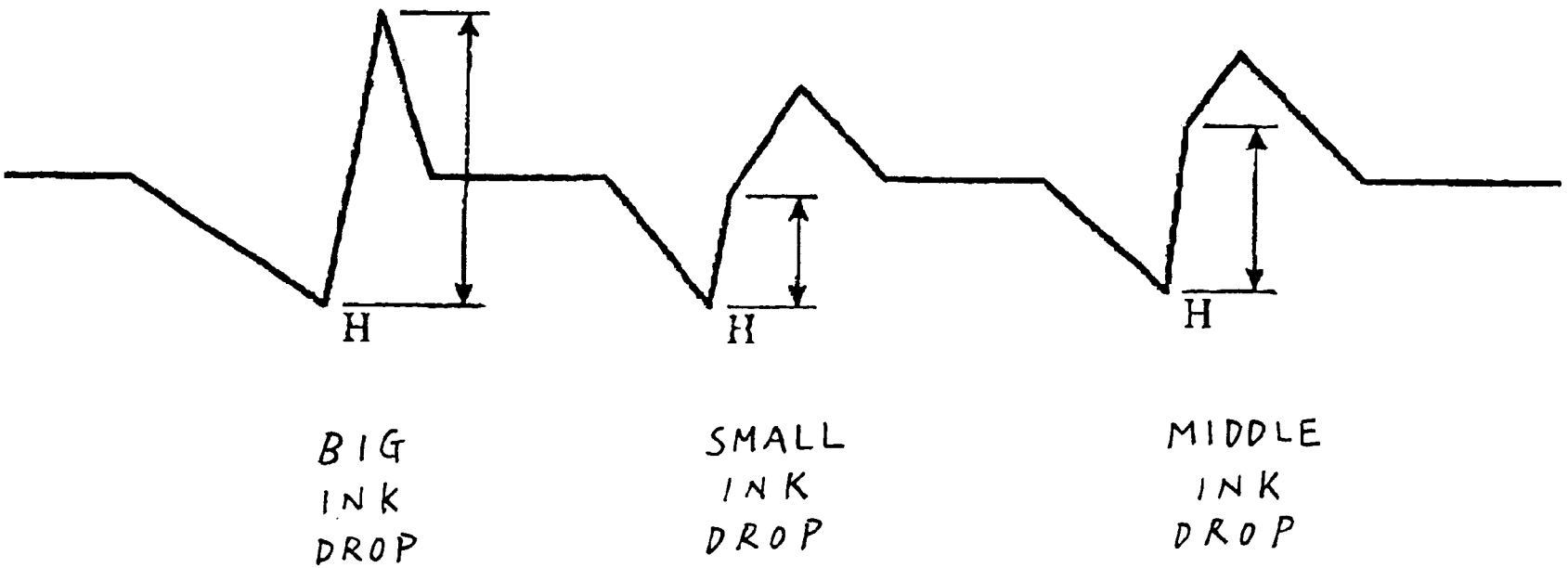
FIG. 5 is a time chart showing a modification of drive waveforms fed to a piezoelectric element for injecting ink drops.

FIG. 5 shows drive waveforms for injecting big, small and middle ink drops according to a modification of the foregoing preferred embodiment. In this modification, a standby voltage of a drive waveform is not a maximum voltage, and the size of an ink drop is determined by a magnitude of a voltage variation from a voltage changing point H, to which the voltage is lowered from the standby voltage, to a point to which the voltage is sharply raised with a constant slope from the voltage changing point H.

While the present invention has been described in terms of the preferred embodiment, the invention is not to be limited thereto, but can be embodied in various ways without departing from the principle of the invention as defined in the appended claims.

What is claimed is:

1. An inkjet printing method wherein ink drops injected from a nozzle one by one to be hit upon a print medium have at least two different sizes, said method comprising the step of changing an injection timing of the ink drop from the nozzle depending on the size of the ink drop to be injected.

2. The inkjet printing method according to claim 1, wherein the ink drop having one of said at least two different sizes is set to be a reference ink drop for determining said injection timing and, when the ink drop to be injected is bigger than said reference ink drop, the injection timing thereof is delayed relative to a given drive period of the reference ink drop.

3. The inkjet printing method according to claim 1, wherein the ink drop having one of said at least two different sizes is to be a reference ink drop for determining said injection timing and, when the ink drop to be injected is smaller than said reference ink drop, the injection timing thereof is advanced relative to a given drive period of the reference ink drop.

4. An inkjet printing method wherein at least two kinds of drive waveforms having different amplitudes are supplied depending on print data and an ink drop is injected from a nozzle by displacing a meniscus of ink in the nozzle according to each of the drive waveforms, said method comprising the step of changing an injection timing of the ink drop from the nozzle depending on the amplitude of the corresponding drive waveform.

5. The inkjet printing method according to claim 4, wherein the ink drop to be injected by the drive waveform having one of said different amplitudes is set to be a reference ink drop for determining said injection timing and, when the amplitude of the drive waveform for the ink drop to be injected is greater than the amplitude of the drive waveform for said reference ink drop, the injection timing thereof is delayed relative to a given drive period of the reference ink drop.

6. The inkjet printing method according to claim 4, wherein the ink drop to be injected by the drive waveform having one of said different amplitudes is set to be a reference ink drop for determining said injection timing and, when the amplitude of the drive waveform for the ink drop to be injected is smaller than the amplitude of the drive waveform for said reference ink drop, the injection timing thereof is advanced relative to a given drive period of the reference ink drop.

7. An inkjet printing method wherein when ink drops are injected from a nozzle one by one, at least two kinds of pressure variations having different amplitudes are applied to ink in the nozzle, said method comprising the step of changing an injection timing of the ink drop from the nozzle depending on the amplitude of the pressure variation applied to the ink.

8. The inkjet printing method according to claim 7, wherein the ink drop to be injected by the pressure variation having one of said different amplitudes is set to be a reference ink drop for determining said injection timing and, when the amplitude of the pressure variation for the ink drop to be injected is greater than the amplitude of the pressure variation for said reference ink drop, the injection timing thereof is delayed relative to a given drive period of the reference ink drop.

9. The inkjet printing method according to claim 7, wherein the ink drop to be injected by the pressure variation having one of said different amplitudes is set to be a reference ink drop for determining said injection timing and, when the amplitude of the pressure variation for the ink drop to be injected is smaller than the amplitude of the pressure variation for said reference ink drop, the injection timing thereof is advanced relative to a given drive period of the reference ink drop.

10. An inkjet printing method wherein when ink drops are injected from a nozzle one by one, the ink drops have at least two different initial injection speeds, said method comprising the step of changing an injection timing of the ink drop from the nozzle depending on the initial injection speed of the ink drop to be injected.

11. The inkjet printing method according to claim 10, wherein the ink drop to be injected at one of said two different initial injection speeds is set to be a reference ink drop for determining said injection timing and, when the initial injection speed of the ink drop to be injected is greater than the initial injection speed of said reference ink drop, the injection timing thereof is delayed relative to a given drive period of the reference ink drop.

12. The inkjet printing method according to claim 11, wherein when the initial injection speed of the ink drop to be injected is greater than the initial injection speed of the reference ink drop, the injection timing thereof is delayed by time_1 [sec] relative to the given drive period of the reference ink drop, $$\text{time_}\mathbf{1}=L\times|(1/v\mathbf{1})-(1/v_def)|$$

wherein L represents a distance [mm] from a tip of the nozzle to a print medium, v1 represents the initial injection speed [m/s] of the ink drop to be injected, and v_def represents the initial injection speed [m/s] of the reference ink drop.

13. The inkjet printing method according to claim 10, wherein the ink drop to be injected at one of said two different-initial injection speeds is set to be a reference ink drop for determining said injection timing and, when the initial injection speed of the ink drop to be injected is smaller than the initial injection speed of said reference ink drop, the injection timing thereof is advanced relative to a given drive period of the reference ink drop.

14. The inkjet printing method according to claim 13, wherein when the initial injection speed of the ink drop to be injected is smaller than the initial injection speed of the reference ink drop, the injection timing thereof is advanced by time_3 [sec] relative to the given drive period of the reference ink drop, $$\text{time_}\mathbf{3}=L\times|(1/v\mathbf{3})-(1/v_def)|$$

wherein L represents a distance [mm] from a tip of the nozzle to a print medium, v3 represents the initial injection speed [m/s] of the ink drop to be injected, and v_def represents the initial injection speed [m/s] of the reference ink drop.

15. An inkjet printing device comprising:

a drive waveform feed device for feeding at least two kinds of drive waveforms having different amplitudes depending on print data;

a deform device which deforms according to the drive waveform fed from said drive waveform feed device;

a pressure chamber which is supplied with ink and injects an ink drop via a nozzle by displacing a meniscus of the ink filled therein due to pressures applied to the ink and caused by deformation of said deform device; and a timing adjusting device which receives the amplitudes of the drive waveforms from said drive waveform feed device and adjusts a feed timing of the corresponding drive waveform to said deform device depending on the corresponding amplitude thereof, so that an injection timing of the ink drop via the nozzle is changed depending on the amplitude of the corresponding drive waveform.

16. The inkjet printing device according to claim 15, wherein the ink drop to be injected by the drive waveform having one of said different amplitudes is set to be a reference ink drop for determining said injection timing and, when the amplitude of the drive waveform for the ink drop to be injected is greater than the amplitude of the drive waveform for said reference ink drop, said timing adjusting device delays the feed timing of the drive waveform for the ink drop to be injected so that the injection timing thereof is delayed relative to a given drive period of the reference ink drop.

17. The inkjet printing device according to claim 15, wherein the ink drop to be injected by the drive waveform having one of said different amplitudes is set to be a reference ink drop for determining said injection timing and, when the amplitude of the drive waveform for the ink drop to be injected is smaller than the amplitude of the drive waveform for said reference ink drop, said timing adjusting device advances the feed timing of the drive waveform for the ink drop to be injected so that the injection timing thereof is advanced relative to a given drive period of the reference ink drop.

18. An inkjet printing device comprising:

a drive waveform feed device for feeding drive waveforms;

a deform device which deforms according to the drive waveform fed from said drive waveform feed device; and a pressure chamber which is supplied with ink and injects an ink drop via a nozzle due to pressure variation applied to the ink filled therein and caused by deformation of said deform device, said pressure variation having at least two kinds of amplitudes depending on the deformation of said deform device, wherein an injection timing of the ink drop via the nozzle is changed depending on the amplitude of the pressure variation applied to the ink.

19. The inkjet printing device according to claim 18, wherein the ink drop to be injected by the pressure variation having one of said amplitudes is set to be a reference ink drop for determining said injection timing and, when the amplitude of the pressure variation for the ink drop to be injected is greater than the amplitude of the pressure variation for said reference ink drop, the injection timing thereof is delayed relative to a given drive period of the reference ink drop.

20. The inkjet printing device according to claim 18, wherein the ink drop to be injected by the pressure variation having one of said amplitudes is set to be a reference ink drop for determining said injection timing and, when the amplitude of the pressure variation for the ink drop to be injected is smaller than the amplitude of the pressure variation for said reference ink drop, the injection timing thereof is advanced relative to a given drive period of the reference ink drop.

21. An inkjet printing device comprising:

a drive waveform feed device for feeding drive waveforms;

a deform device which deforms according to the drive waveform fed from said drive waveform feed device; and a pressure chamber which is supplied with ink and injects an ink drop via a nozzle due to change in internal volume of said pressure chamber caused by deformation of said deform device, said volume change having at least two kinds of amplitudes depending on the deformation of said deform device, wherein an injection timing of the ink drop via the nozzle is changed depending on the amplitude of said volume change.

22. The inkjet printing device according to claim 21, wherein the ink drop to be injected by the volume change having one of said amplitudes is set to be a reference ink drop for determining said injection timing and, when the amplitude of the volume change for the ink drop to be injected is greater than the amplitude of the volume change for said reference ink drop, the injection timing thereof is delayed relative to a given drive period of the reference ink drop.

23. The inkjet printing device according to claim 21, wherein the ink drop to be injected by the volume change having one of said amplitudes is set to be a reference ink drop for determining said injection timing and, when the amplitude of the volume change for the ink drop to be injected is smaller than the amplitude of the volume change for said reference ink drop, the injection timing thereof is advanced relative to a given drive period of the reference ink drop.

* * * * *